US005086742A

United States Patent [19]

Vogtmann

[11] Patent Number: 5,086,742

[45] Date of Patent: Feb. 11, 1992

[54] FUEL INJECTION PUMP FOR INTERNAL COMBUSTION ENGINES

[75] Inventor: Hans-Jörg Vogtmann, Markgroningen, Fed. Rep. of Germany

[73] Assignee: Robert Bosch GmbH, Stuttgart, Fed. Rep. of Germany

[21] Appl. No.: 726,112

[22] Filed: Jun. 21, 1991

Related U.S. Application Data

[63] Continuation of Ser. No. 147,481, Jan. 25, 1988, abandoned.

[30] Foreign Application Priority Data

Feb. 13, 1987 [DE] Fed. Rep. of Germany ..... 3704580

[51] Int. Cl.[5] ..... F02M 41/00

[52] U.S. Cl. ..... 123/449; 123/496; 123/373

[58] Field of Search ..... 123/449, 496, 506, 373

[56] References Cited

U.S. PATENT DOCUMENTS

| | | | |
|---|---|---|---|
| 4,164,921 | 8/1979 | Hofer | 123/506 |
| 4,327,696 | 5/1982 | Kobayashi | 123/506 |
| 4,407,253 | 10/1983 | Bauer | 123/506 |
| 4,458,648 | 7/1984 | Braun | 123/506 |
| 4,510,908 | 4/1985 | Eisele | 123/449 |
| 4,548,184 | 10/1985 | Laufer | 123/449 |
| 4,593,668 | 6/1986 | Yuzawa | 123/506 |

*Primary Examiner*—Carl Stuart Miller

*Attorney, Agent, or Firm*—Edwin E. Greigg; Ronald E. Greigg

[57] ABSTRACT

For the sake of improving quiet operation during idling and at low partial load by lengthening the injection duration, a fuel injection pump for internal combustion engines has a relief conduit originating in a pump work chamber, the relief conduit including a throttle and being blockable at upper partial load, full load and openable by a control slide. The relief conduit is controlled by a pressure maintenance valve, the opening pressure of which can be adapted from outside to the opening pressure of injection nozzles. The control slide is controlled by a centrifugal governor in such a manner that at idling and lower partial load. The control slide is shifted by the pressure in a fuel low-pressure chamber into its operating position that uncovers the relief conduit, and at upper partial load, full load and starting, the control slide is disconnected from the low-pressure chamber, so that it can drop back into its basic position that blocks off the relief conduit.

8 Claims, 1 Drawing Sheet

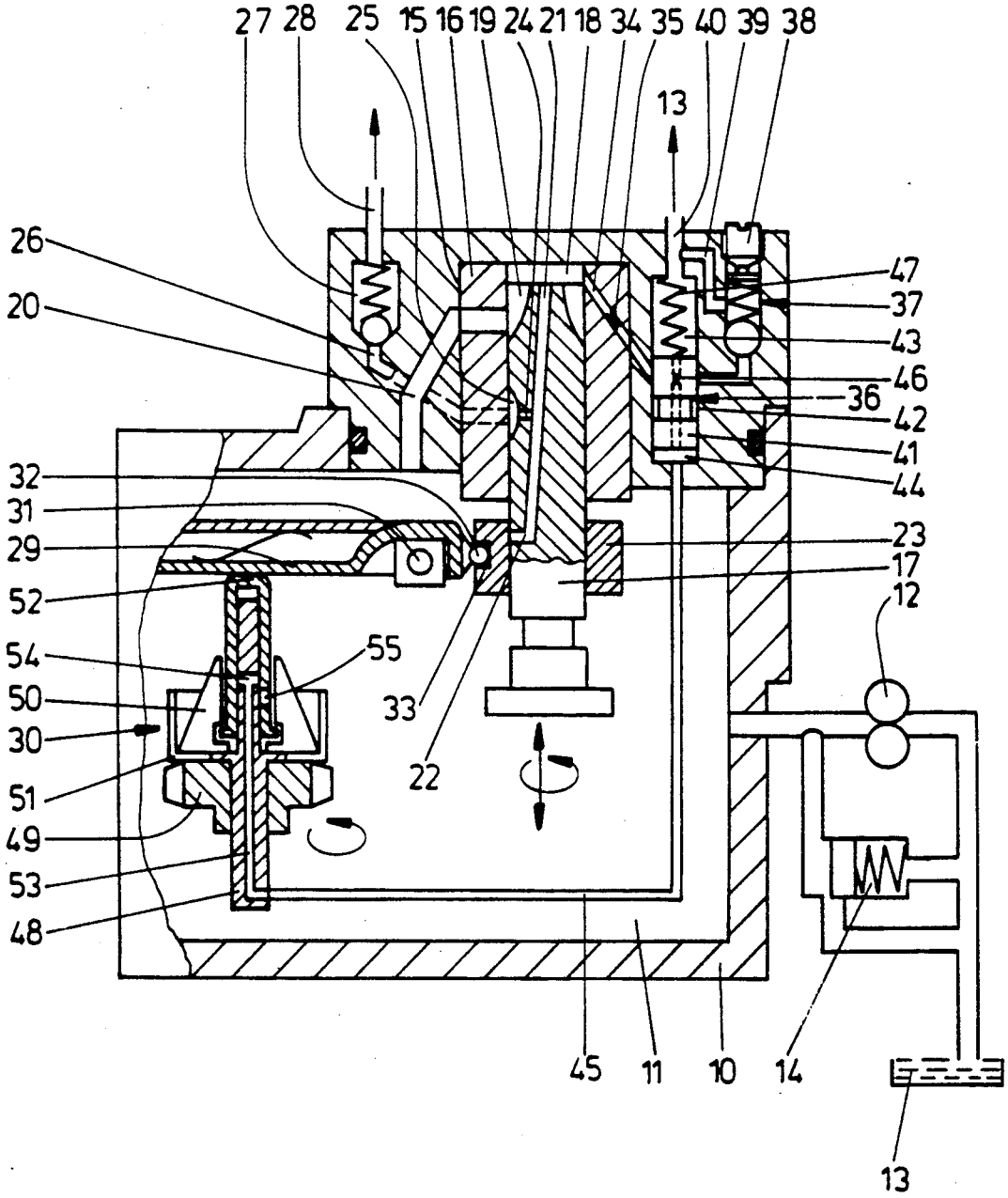
27
28
25
15
16
19
24
21
18
34
35
40
39
38
13
26
20
47
37
43
46
36
42
41
44
32
31
29
52
23
17
12
54
55
50
30
51
49
53
48
33
22
45
11
10
14
13

FUEL INJECTION PUMP FOR INTERNAL COMBUSTION ENGINES

This is a continuation of copending application Ser. No. 07/147,481 filed on Jan. 25, 1988, now abandoned.

BACKGROUND OF THE INVENTION

The invention is based on a fuel injection pump for internal combustion engines.

In fuel injection pumps of this kind, used for Diesel engines, the injection duration is lengthened in idling and at low partial load for the sake of quieter idling, while at upper partial load or full load it is left unchanged.

In a known fuel injection pump of this kind (German Offenlegungsschrift 30 13 087), the relief conduit is connected for this purpose to a pump interior that can be made to communicate with the pump work chamber via a suction conduit and longitudinal grooves in the pump piston and is filled with fuel at feed pressure. A governor slide that slides on the pump piston in the pump work chamber controls a control bore that communicates with the pump work chamber, and thereby determines the end or onset of injection depending on the position of the control bore in the pump piston. The mouth of the relief conduit in the pump work chamber is guided via the pump piston and is covered by the governor slide in such a manner that the mouth is uncovered only once while the pump piston is executing a predetermined pre-stroke for generating the injection pressure. Once the mouth of the relief conduit is uncovered, part of the fuel in the pump work chamber flows back into the pump interior. The diversion of part of the fuel thus takes place only after the opening of the injection nozzle, that is, after the injection onset. At upper partial load or full load, the control slide is displaced into its blocking position, in which it blocks off the relief conduit, by the governor slide, or a control element engaging the governor slide. From then on, the injection duration is determined only by the pump piston stroke and the position of the governor slide.

With this kind of quiet-idling provision, it must be noted that typically there is a stroke difference of only 0.1 mm at maximum between the "end of supply, idling" position and the "end of supply, full load" position. This slight stroke difference is all that is available for the control path of the control slide. Given this small coincidence value and the high pressure of the fuel located in the pump work chamber, inconsiderable leakage problems may arise, which can be overcome only if the pump piston head is accurately calibrated with respect to the location of its control bore.

Furthermore, the "pre-stressing" of the entire high-pressure space until the relief conduit is uncovered is defined via a fixed ground-in dimension of the pump piston head. If the nozzle opening pressure changes, for instance, or if carbonization partially plugs the opening, the pre-stressing cannot be adapted to these changes. The tolerances of the governor slide and control bore also enter into this ground-in dimension of the pump piston head, however, and so re-machining of this dimension is often necessary. This makes mass production of the known injection pump problematic.

OBJECT AND SUMMARY OF THE INVENTION

The fuel injection pump according to the invention has the advantage that the idling setting can be optimized by means of the pressure maintenance valve, which is accessible from outside for the setting of its opening pressure, and if the opening pressure of the injection nozzle varies, the idling setting can be readjusted. The pre-stressing of the pump work chamber is effected via the adjustable pressure maintenance valve, not via a fixed ground-in dimension in the pump piston head, and thus can be adapted to varying conditions resulting from carbonization, nozzle opening pressure changes, etc. The tolerance-bound location of the governor slide with respect to the control bore in the pump piston has no significance. It becomes unnecessary to dispose an additional bore in the pump piston.

An advantage of the invention is obtained since the location of the governor sleeve of the centrifugal governor is a standard for the quantity of fuel injected as a function of load, and the control chamber of the control slide is closed in a load-dependent manner (upper partial load or full load) or made to communicate with the pump interior (lower partial load or idling). The positioning piston of the control slide is thus moved as a function of load, and the relief conduit is hence opened or closed in accordance with load. At engine starting, when a large fuel injection quantity is needed, the relief conduit is automatically closed, so that the gas pedal need not be actuated for starting. The extent of fuel cutoff for load-dependent closure of opening of the relief conduit is set at the governor sleeve and then transmitted, hydraulically amplified, to the positioning piston of the control slide. The travel of the control piston is represented at the governor sleeve with a factor of approximately 2.20 over that of the prior art. For controlling the cutoff, there is thus a considerably longer path available than with the known fuel injection pump initially mentioned above, so that neither leakage problems nor tolerance problems arise. Furthermore, the cutoff extent can be very precisely adjusted by means of the governor sleeve, which is typically adjustable from outside.

The invention will be better understood and further objects and advantages thereof will become more apparent from the ensuing detailed description of a preferred embodiment taken in conjunction with the drawing.

BRIEF DESCRIPTION OF THE DRAWING

The single FIGURE of the drawing shows a schematic longitudinal section through a distributor-type fuel injection pump according to the invention.

DESCRIPTION OF THE PREFERRED EMBODIMENT

The distributor injection pump shown in longitudinal section in the drawing includes a two-part pump housing 10, which encloses a pump interior 11. The pump interior 11 is supplied with fuel from a fuel container 13 via a feed pump 12. The fuel in the pump interior 11 is at overpressure, the so-called feed pressure, which is controlled in accordance with rpm in a known manner by a pressure control valve 14, the pressure in the pump interior 11 increases with increasing rpm.

A cylinder liner 16 is introduced into a bore 15 in the pump housing 10, and operating in the cylinder liner is a pump piston 17, which is set into reciprocating and simultaneously rotating motion by a cam-drive shaft, not shown, counter to the force of a restoring spring, also not shown. The housing, pump piston 17 and the cylinder liner 16 enclose a pump work chamber 18, to which, upon the intake stroke of the pump piston 17, fuel is supplied from the pump interior 11 via a suction conduit 20 and longitudinal grooves 19 disposed in the jacket face of the pump piston 17. Extending in the pump piston 17 is a longitudinal conduit 21, which connects at one end with in the pump work chamber 18 and at the other end in a radial control bore 22, which is provided in the section of the pump piston 17 that protrudes into the pump interior 11. The control bore 22 is controlled by a governor slide 23 guided on the pump piston 17. Branching off from the longitudinal conduit 21 is a transverse bore 24, which discharges in a longitudinal distributor groove 25 in the jacket face of the pump piston 17 which discharges into a plurality of conduits equally spaced about the piston. Via the longitudinal conduit 21, the transverse bore 24 and the longitudinal distributor groove 25, the suction conduit 20 is closed each time the pump piston 17 rotates during its compression stroke, and one of the pressure conduits 26 provided in the pump housing 10 is opened up, so that the fuel, which is at high pressure, can flow out of the pump work chamber 18 into whichever pressure conduit 26 has been opened. The pressure conduits 26 disposed about and emanating radially from the pump piston 17 each lead via a check valve 27 to pressure lines 28, each of which communicate with one of the injection nozzles, not shown, on the engine. Once a certain compression stroke has been executed, the control bore 22 is opened up by its emergence from the governor slide 23, by means of which the injection is interrupted, and the remaining fuel flows out of the pump work chamber 18 into the pump interior 11.

The governor slide 23 is displaced on the pump piston 17 via an intermediate lever 29 of a centrifugal governor 30 in a known manner, as a function of load and rpm. To this end, a head 32 of the intermediate lever 29, which is pivotably supported at the pivot point 31, engages a recess 33 in the governor slide 23. A downward displacement of the head 32 reduces the injection quantity, and an upward displacement increases it. For starting rpm, the governor slide 23 assumes its uppermost position, in which the control bore 22 is no longer uncovered, so that the entire fuel quantity in the pump work chamber 18 is injected.

Also braching off from the pump work chamber 18 is a relief conduit 34 that extends to a bore 42 in the housing. The relief conduit includes a throttle 35, shown only schematically. A control slide 36 is operative in the bore 42 relative to the relief conduit 34 and a pressure maintenance valve 37. The relief conduit 34 and pressure maintenance valve are closed off by the control slide 36 and the opening pressure of the pressure maintanance valve 37 is adjustable via a set screw 38 that is adjustable from the outside. This opening pressure is dimensioned such that it is lower than the opening pressure of the injection nozzles and higher than their closing pressure. In this way, the pressure maintenance valve 37 opens shortly before the injection onset, so that the throttle 35 in the relief conduit 34 is operative from the supply onset to the end of supply, resulting in a lengthened supply duration. The outlet of the pressure maintenance valve 37 communicates, via an outlet bore 39 extending within the housing 10, with a fuel return line 40 leading from the bore 42 to the fuel container 13. The control slide 36, which because of its small size can be disposed very close to the pump piston 17, has a positioning piston 41, which is guided axially displaceably in the bore 42 in the pump housing 10. The positioning piston is formed as a spool piston having an upper end and a lower end separated by a smaller diameter section. The positioning piston 41 defines with the housing a spring chamber 43 with its upper end face, and with its lower end face defines a hydraulic control chamber 44. The spring chamber 43 is connected to the fuel return line 40, while the control chamber 44 communicates via a hydraulic control line 45 with the centrifugal governor 30, which either connects the control chamber 44 with or blocks it off from the pump interior 11 via the axial bore 53, transverse bore 54 in holder 48, and the radial control opening 55 in the governor sleeve 52, as a function of load. The spring chamber 43 and the control chamber 44 communicate with one another through a throttle bore 46 extending axially in the positioning piston 41. A relatively weak displacement spring 47 is disposed in the spring chamber 43, urging the positioning piston 41 counter to the action of the control chamber 44 and displacing the positioning piston into its basic position as shown, in which the relief conduit 34 and inlet to the pressure maintenance valve are blocked off. The spring force of the displacement spring 47 is dimensioned such that when the control chamber 44 is blocked off from the pump piston interior 11, the spring shifts the positioning piston 41 into its basic position that blocks off the relief conduit, and when the control chamber 44 is connected to the pump interior 11, via the governor sleeve, it allows a displacement of the positioning piston 41 into its operating position where the reduced diameter portion uncovers the relief conduit 34 and the opening to the pressure maintenance valve. The pressure maintenance valve then controls fuel flow from the work chamber via conduit 34 and opens according to the setting of the screw 38.

The centrifugal governor 30 is driven in a known manner by the drive shaft, not shown, of the pump piston 17. The rpm of the drive shaft is transmitted to flyweights 50 via a gear wheel 49 supported on a holder 48. With increasing rpm, centrifugal force comes into play, and the flyweights 50 are moved outward. In this motion, they each rotate about a respective knife-edge bearing 51, and via their inner shanks they displace the governor sleeve 52 seated axially displaceably on the holder 48. The governor sleeve 52 transmits its displacement motion in a known manner to the intermediate lever 29, which in turn varies the position of the governor slide 23 relative to the control bore 22. The holder 48 has an axial bore 53, which at one end discharges into the transverse bore 54 disposed in the holder 48 in the vicinity of the governor sleeve 52 and at the other end communicates with the control line 45. The radial control opening 55 in the governor sleeve 52 cooperates with the transverse bore 54 in the holder and is disposed in such a manner relative to the transverse bore 54 that in the position that the governor sleeve 52 assumes at lower partial load or idling, the control opening 55 and the transverse bore 54 coincide with one another and is open to the fuel chamber 11, and that in the position the governor sleeve 52 assumes at upper partial load or full load, the transverse bore 54 is covered by the governor sleeve. Thus at idling or lower partial load, the pump interior 11 communicates with the control chamber 44 of the control slide 36, via the governor sleeve, as a result of which the positioning piston 41 is displaced into its operating position where the central smaller diameter portion uncovers the relief conduit 34, while at upper partial load or full load the control chamber 44 of the control slide 36 is closed off, so that the positioning piston 41 is shifted by the displacement spring 47 into its basic position, shown in the drawing, in which the position piston blocks off the relief conduit 34. In that case, the fuel located in the control chamber 44 escapes via the throttle bore 46, so that the positioning piston 41 can assume its basic position relatively rapidly after the closure of the control chamber 44. The leakage quantities are returned to the fuel container 13 via the fuel return line 40.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines, comprising a housing, a piston bore in said housing, a piston operative in said piston bore, a pump work chamber defined in said housing, by said pump piston, at least one pressure line leading from said work chamber to at least one injection nozzle, a relief conduit (34) extending from said work chamber for diverting a partial fuel quantity during a compression stroke of said pump piston in order to lengthen injection duration, a throttle (35) in said relief conduit, a control slide (36) disposed in said relief conduit for blocking off said relief conduit at upper partial load and at full load, an adjustable pressure maintenance valve (37) in said relief conduit for closing off said relief conduit, and means for adjusting an opening pressure of said adjustable pressure maintenance valve (37) in accordance with the opening pressure of said at least one injection nozzle.

2. A fuel injection valve as defined by claim 1, in which said control slide (36) includes a positioning piston (41), a spring chamber (43) on one end face of said positioning piston, a fuel return line connected to said spring chamber, a hydraulic ocntrol chamber (44) on an opposite face of said positioning piston, a throttle bore (46) in said positioning piston which extends from said spring chamber (43) to said hydraulic control chamber (44), a displacement spring (47) disposed in the spring chamber (43) which acts upon said positioning piston (41) for controlling said control slide, a hydraulic control line (45) which connects said hydraulic control chamber with a centrifugal governor (30) that includes flyweights (50), and a fuel filled low-pressure chamber 11 which depending on the position of said flyweights (50) either connects said fuel-filled low-pressure chamber (11), with, or blocks it off from said control line (45).

3. A fuel injection pump as defined by claim 2, in which said spring (47) has a spring force dimensioned such that when the control chamber (44) is blocked off the spring (47) shifts said positioning piston (41) into its basic position blocking off the relief conduit (34) from said pressure maintenance valve, and when the control chamber (44) is connected to said fuel filled low-pressure chamber (11), said spring (47) allows a displacement of the positioning piston (41) into its operating position uncovering the relief conduit (34) and an inlet to said pressure maintenance valve.

4. A fuel injection pump as defined by claim 2, in which said centrifugal governor (30) includes a holder (48) and a governor sleeve (52) that protrudes at least into said low-pressure chamber (11), said governor sleeve is axially displaceable on said holder (48) by flyweights (50), said holder (48) has an axial bore (53), which at one end communicates with a bore (54) provided in the holder (48) in a displacement range of said governor sleeve (52) and at an opposite end communicates with said control line (45), a control opening (55) in said governor sleeve (52) that cooperates with said bore (54), said control opening (55) being disposed relative to the bore (54) such that in a position assumed by the governor sleeve (52) at lower partial load or idling, said control opening (55) and the bore (54) coincide with one another and is open to the fuelfilled low pressure chamber and that in the position assumed by the governor sleeve (52) at upper partial load or full load, the bore (54) is covered by the governor sleeve (52).

5. A fuel injection pump as defined by claim 3, in which said centrifugal governor (30) includes a holder (48) and a governor sleeve (52) that protrudes at least into said low-pressure chamber (11), said governor sleeve is axially displaceable on said holder (48) by flyweights (50), said holder (48) has an axial bore (53), which at one end communicates with a bore (54) provided in the holder (48) in a displacement range of said governor sleeve (52) and at an opposite communicates with said control line (45), a control opening (55) in said governor sleeve (52) that cooperates with said transverse bore (54), said control opening (55) being disposed relative to the bore (54) such that in a position assumed by the governor sleeve (52) at lower partial load or idling, said control opening (55) and the bore (54) coincide with one another and is open to the fuel-filled low pressure chamber and that in the position assumed by the governor sleeve (52) at upper partial load or full load, the bore (54) is covered by the governor sleeve (52).

6. A fuel injection valve as defined by claim 1, in which said pressure maintenance valve has an inlet connected with a control slide cylinder in which said control slide operates, and an outlet downstream of said control slide connnected with an outlet of said control slide cylinder.

7. In a fuel injection pump for internal combustion engines for lengthening an injection duration which comprises: a work chamber, a position piston cylinder, a refief conduit (34) extending from said work chamber to said position piston cylinder, an adjustable pressure maintenance valve (37), an inlet extending from said position piston cylinder to said adjustable pressure maintenance valve, said adjustable pressure maintenance valve (37) having an opening pressure which is adjustable via an adjusting screw that is adjustable from outside, a spool piston (36) operative in said position piston cylinder, said spool piston having upper and lower portions of the same diameter separated by a central section (42) of smaller diameter, control means for controlling a position of said spool piston relative to said relief conduit to permit fuel flow from said relief conduit to said adjustable pressure maintenance valve when said reduced diameter portion of said spool piston is in the vicinity of said conduit connection with said position piston cylinder and said inlet to said adjustable maintenance valve, whereby said relief conduit and inlet are closed when said spool piston is in its normal position.

8. In a fuel injectin pump for internal combustion engines for lengthening an injection duration as set forth in claim 7 in which said relief conduit includes a throttle therein, and said throttle in said relief conduit has a constant cross section.

* * * * *